US010027059B2

(12) United States Patent
Byrne et al.

(10) Patent No.: US 10,027,059 B2
(45) Date of Patent: Jul. 17, 2018

(54) TWIST-LOCK ELECTRICAL CONNECTOR

(71) Applicants: Norman R. Byrne, Ada, MI (US); Marc A. Mitchell, Belmont, MI (US); Robert L. Knapp, Rockford, MI (US); Nickolas J. Morrow, Ada, MI (US)

(72) Inventors: Norman R. Byrne, Ada, MI (US); Marc A. Mitchell, Belmont, MI (US); Robert L. Knapp, Rockford, MI (US); Nickolas J. Morrow, Ada, MI (US)

( * ) Notice: Subject to any disclaimer, the term of this patent is extended or adjusted under 35 U.S.C. 154(b) by 0 days.

(21) Appl. No.: 15/581,304

(22) Filed: Apr. 28, 2017

(65) Prior Publication Data

US 2017/0317446 A1 Nov. 2, 2017

Related U.S. Application Data

(60) Provisional application No. 62/330,582, filed on May 2, 2016.

(51) Int. Cl.
*H01R 4/50* (2006.01)
*H01R 13/627* (2006.01)
(Continued)

(52) U.S. Cl.
CPC ..... *H01R 13/6273* (2013.01); *H01R 13/04* (2013.01); *H01R 13/113* (2013.01)

(58) Field of Classification Search
CPC .... H01R 13/625; H01R 17/005; H01R 33/46; H01R 13/64
(Continued)

(56) References Cited

U.S. PATENT DOCUMENTS 2,234,982 A 3/1941 Ross
3,363,214 A 1/1968 Wright
(Continued)

FOREIGN PATENT DOCUMENTS

FR 2938383 5/2010
WO WO2013165049 11/2013
(Continued)

OTHER PUBLICATIONS

MagSafe, Retrieved from http://en.wikipedia.org/wiki/MagSafe on Feb. 26, 2015.
(Continued)

*Primary Examiner* — Phuong Chi T Nguyen
(74) *Attorney, Agent, or Firm* — Gardner, Linn, Burkhart & Ondersma LLP

(57) ABSTRACT

A twist-lock electrical connector includes first and second connector portions each having a respective interface end portion and longitudinal axes. The first connector has a projection and the second connector has a corresponding bore along the connectors' respective longitudinal axes. Two electrical contacts are located at opposite sides of the projection at the first interface end portion, and two other electrical contacts are located at opposite sides of the bore at the second interface end portion. The interface end portions are configured to engage one another at a first rotational orientation in which the bore receives the projection when the first and second longitudinal axes are made substantially coaxial and the connector portions are brought together along their axes. The interface end portions further engage one another at a second rotational orientation in which the first pair of electrical contacts electrically engage the second pair of electrical contacts.

20 Claims, 16 Drawing Sheets

(51) Int. Cl.
*H01R 13/04* (2006.01)
*H01R 13/11* (2006.01)

(58) Field of Classification Search
USPC ..... 439/332, 335, 337, 339, 282, 279, 680
See application file for complete search history.

(56) References Cited

U.S. PATENT DOCUMENTS

| | | | | |
|---|---|---|---|---|
| 4,112,941 | A | 9/1978 | Larimore | |
| 4,737,122 | A * | 4/1988 | Dechelette | H01R 24/60 439/418 |
| 5,401,175 | A | 3/1995 | Guimond et al. | |
| 5,909,100 | A | 6/1999 | Watanabe et al. | |
| 6,250,931 | B1 | 6/2001 | Mendelson | |
| 6,478,614 | B1 | 11/2002 | De'Longhi | |
| 6,561,815 | B1 | 5/2003 | Schmidt | |
| 6,975,876 | B1 * | 12/2005 | Cast | H04L 51/12 370/237 |
| 7,207,825 | B2 * | 4/2007 | Le Gallic | H01R 13/6275 439/357 |
| 7,344,380 | B2 | 3/2008 | Neidlein et al. | |
| 7,351,066 | B2 | 4/2008 | DiFonzo et al. | |
| 7,641,477 | B2 | 1/2010 | DiFonzo et al. | |
| 7,658,613 | B1 | 2/2010 | Griffen et al. | |
| 7,726,974 | B2 | 6/2010 | Shah et al. | |
| 7,741,806 | B2 | 6/2010 | Kuhlmann et al. | |
| 8,022,664 | B2 | 9/2011 | Shu | |
| 8,057,250 | B2 * | 11/2011 | Lim | H01R 13/5812 439/470 |
| 8,418,875 | B2 * | 4/2013 | Sorensen | B29C 45/006 220/592.2 |
| 8,915,609 | B1 | 12/2014 | Shah et al. | |
| 9,130,291 | B2 | 9/2015 | Poh et al. | |
| 2005/0082915 | A1 | 4/2005 | Steinberg | |
| 2006/0152945 | A1 | 7/2006 | Lantzsch et al. | |
| 2007/0254510 | A1 | 11/2007 | DeBey | |
| 2011/0028006 | A1 | 2/2011 | Shah et al. | |
| 2012/0177323 | A1 | 7/2012 | Schwandt et al. | |
| 2012/0183258 | A1 | 7/2012 | Schwandt et al. | |
| 2012/0183262 | A1 | 7/2012 | Schwandt et al. | |
| 2012/0189155 | A1 | 7/2012 | Gabara | |
| 2012/0206090 | A1 | 8/2012 | Hyun-Jun et al. | |
| 2015/0171649 | A1 | 6/2015 | Kim et al. | |
| 2015/0194764 | A1 | 7/2015 | Magana et al. | |

FOREIGN PATENT DOCUMENTS

| | | |
|---|---|---|
| WO | WO2014010781 | 1/2014 |
| WO | WO2014021847 | 2/2014 |

OTHER PUBLICATIONS

Alibaba, Magnetic Connector Power Cord, Retrieved from http://www.alibaba.com/showroom/magnetic-power-connector.html on Feb. 26, 2015.

* cited by examiner

TWIST-LOCK ELECTRICAL CONNECTOR

CROSS-REFERENCE TO RELATED APPLICATION

The present application claims the filing benefits of U.S. provisional applications, Ser. No. 62/330,582, filed May 2, 2016, which is hereby incorporated by reference herein in its entirety.

FIELD OF THE INVENTION

The present invention relates to electrical connectors and, more particularly, to selectively securable electrical connectors for electrical and data cords.

BACKGROUND OF THE INVENTION

Electrical connectors are commonly used for establishing electrical connections between compatible wires or cords, or between wires or cords and compatible devices such as electronics, electrical power consumers, or the like. In some cases, it is desirable to provide a releasable locking or strain-relief feature so that the connections are not readily pulled apart from one another. One example of such locking features is a threaded female collar and threaded male portion for coaxial connectors commonly used for cable television signal transmission.

SUMMARY OF THE INVENTION

The present invention provides a twist-lock electrical connector that may be used for establishing mechanically secure electrical power couplings, electronic data or signal couplings, or the like. The twist-lock electrical connector may be particularly suited to low voltage DC applications, although high voltage AC and data transmission applications are also envisioned. The electrical connector includes two complementary connector portions that first engage one another in an axial direction without establishing electrical connections, and then twist or rotate relative to one another about their longitudinal axes to establish electrical connections and simultaneously lock or latch mechanically together. Once fully engaged, the connector portions cannot be separated without first rotating them in the opposite direction, which disconnects their mechanical and electrical connections. The secured twist-lock electrical connector may have a substantially smooth outer surface without any protrusions, so that the connector and associated wiring may be moved or pulled along other surfaces with low risk of becoming snagged or disconnected by other objects or surfaces.

In one form of the present invention, a twist-lock electrical connector including first and second connector portions having respective interface end portions, respective pairs of electrical contacts, and respective longitudinal axes. The first connector portion has a projection at its interface end portion, extending along the first longitudinal axis, and the second connector portion has a corresponding bore at its interface end portion, extending along its longitudinal axis. The electrical contacts at the first interface end portion are located at opposite sides of the projection, and the electrical contacts at the second interface end portion are located at opposite sides of the bore. The first and second interface end portions are configured so that they can engage one another in an initial orientation with the longitudinal axes being substantially coaxially aligned, and with the bore receiving the projection. The interface end portions are configured to further engage one another at a second orientation, which is rotated about the axes as compared to the first orientation, and with the pairs of electrical contacts electrically engaging one another in the second orientation.

According to one aspect, the first and second interface end portions include respective first and second latching elements that engage one another in the second orientation. The latching elements cooperate to prevent separation of the first and second connector portions.

According to another aspect, the first latching element is a latch arm that extends radially outwardly from the projection, and the second latching element is a ledge formed along one side of the bore and configured to receive the latch arm in the second rotational orientation.

According to still another aspect, the first latching element takes the form of respective distal end portions of the first pair of electrical contacts, with the distal end portions being substantially perpendicular to the first longitudinal axis, and the second latching element includes the second pair of electrical contacts. For example, the first latching elements may be generally L-shaped with a free end including a base leg, and the second latching elements may be generally U-shaped at respective free ends thereof, in which case the base legs of the first latching elements are received in the U-shaped free ends of the second latching elements to provide a securing or latching feature that resist pulling the connector portions apart in a longitudinal direction along the longitudinal axes.

Optionally, a pair of electrically insulating extension walls extend distally adjacent each of the first latching elements, and a pair of electrically insulating extension housings extend distally around each of the second latching elements. The extension housings each define a respective opening through which respective U-shaped free ends of the second latching elements are engaged by respective base legs of the L-shaped first latching elements.

According to a further aspect, a first of the latching elements includes at least one outboard projection at the first interface end portion, the first latching element being spaced radially outwardly from the first longitudinal axis. A second of the latching elements includes a recess formed in the second interface end portion, the second latching element being spaced radially outwardly from the second longitudinal axis. Optionally, the first latching element is generally L-shaped and the second latching element includes a generally L-shaped recess formed in an outer surface of the second interface end portion.

According to a still further aspect, each of the first and second pairs of electrical contacts includes permanent magnets or magnetically permeable material, whereby the first pair of electrical contacts is magnetically attracted to the second pair of electrical contacts in the second rotational orientation. Optionally, the first and second pairs of electrical contacts are movable within the respective bores formed in the first and second interface end portions. The movable contacts facilitate establishing electrical engagement of the first pair of electrical contacts with the second pair of electrical contacts.

In another form of the present invention, a twist-lock electrical connector includes first and second connector portions having respective longitudinal axes, respective interface end portions with generally planar engagement surfaces and electrical contacts. The first connector portion has a pair of extension walls extending forwardly from the first engagement surface and located on opposite sides of the first longitudinal axis. The first electrical contacts extend forwardly of the first engagement surface and are located adjacent the extension walls. The second electrical contacts are positioned in the second interface end portion and are accessible via respective contact openings. The first and second interface end portions are configured to initially engage one another at a first orientation in which the first and second longitudinal axes are substantially coaxial and the first electrical contacts are not contacting the second electrical contacts, and the first and second interface end portions are configured to further engage one another at a second orientation in which the electrical contacts engage one another and the contact openings are covered by the extension walls.

According to one aspect, one of the connector portions includes a projection extending along the first or second longitudinal axis, and the other connector portion includes a bore extending along the second longitudinal axis, the bore being configured to receive the projection in both of the first and second orientations.

Optionally, the projection includes a radially outwardly extending latch arm formed along one side and the bore includes a corresponding ledge formed along one side. The latch arm is configured to engage the ledge in the second orientation, to prevent separation of the first and second connector portions.

According to another aspect, respective outer surfaces of the first and second connector portions cooperate to form a substantially constant-section shape along the first and second interface end portions when in the second orientation.

In yet another form of the present invention, a twist-lock electrical connector includes first and second connector portions, each with a respective interface end portion, a pair of electrical contacts, and a longitudinal axis. The first connector portion has a projection at the first interface end portion, which projection extends along the first longitudinal axis. The projection has a radially outwardly extending latch arm formed at a distal end region. The second connector portion has a bore formed at the second interface end portion along the second longitudinal axis. The bore includes an internal radially-outwardly-extending ledge. The first electrical contacts are located at the first interface end portion and are positioned at opposite sides of the projection. The second electrical contacts are located at the second interface end portion and are positioned at opposite sides of the bore. The first and second interface end portions are configured to engage one another at a first rotational orientation in which the bore receives the projection when the first and second longitudinal axes are substantially coaxial, and the first and second interface end portions will further engage one another at a second rotational orientation in which the first pair of electrical contacts electrically engage the second pair of electrical contacts, and the latch arm engages the ledge to prevent separation of the first and second connector portions.

Therefore, the twist-lock electrical connector can be used to quickly and easily establish mechanically secure and strain-relieved electrical power couplings, electronic data or signal couplings, or the like, using a push-together-and-twist motion for both attaching and detaching the connector portions. The connector portions cannot be separated by initially pulling apart in a longitudinal direction, and must first be rotated to disconnect their mechanical and electrical connections.

These and other objects, advantages, purposes and features of the present invention will become apparent upon review of the following specification in conjunction with the drawings.

DESCRIPTION OF THE PREFERRED EMBODIMENTS

Figure 1:
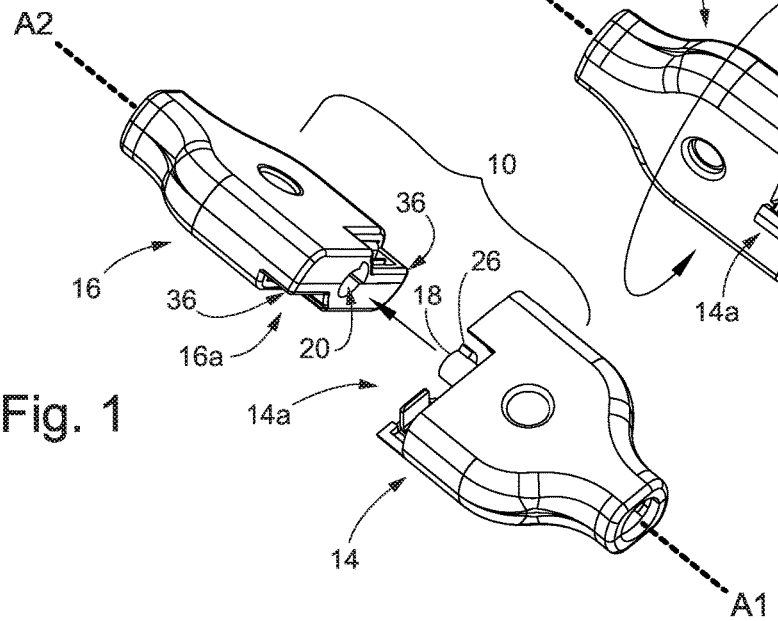
FIG. 1 is a perspective view of two connector portions of a twist-lock electrical connector in accordance with the present invention, shown prior to initial engagement.
Figure 2A:
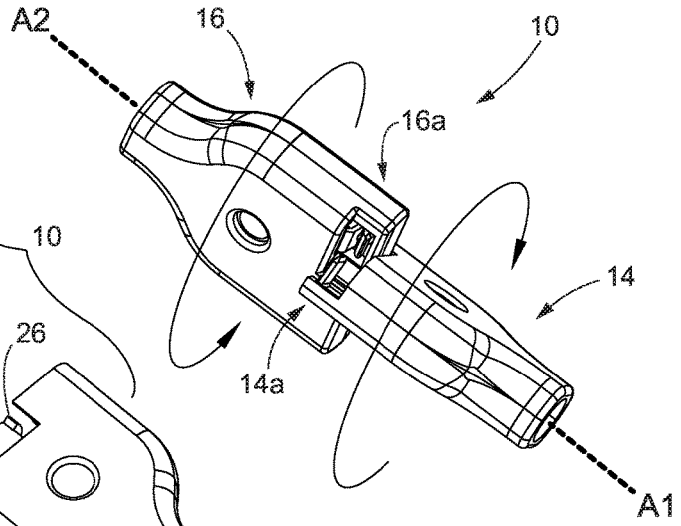
FIGS. 2A and 2B are different perspective views of the two connector portions of FIG. 1, both showing the connector portions after initial engagement and prior to final engagement.
Figure 2B:
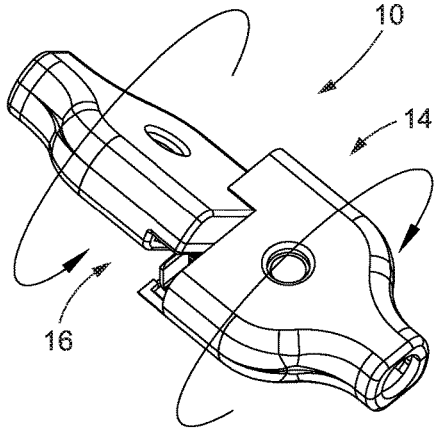
Figure 3:
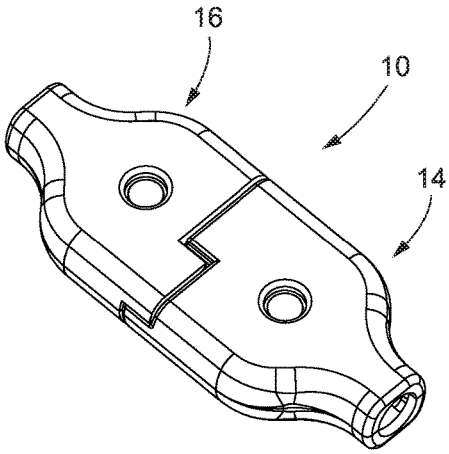
FIG. 3 is a perspective view of the two connector portions of FIG. 1, shown rotated to final engagement.
Figure 4:
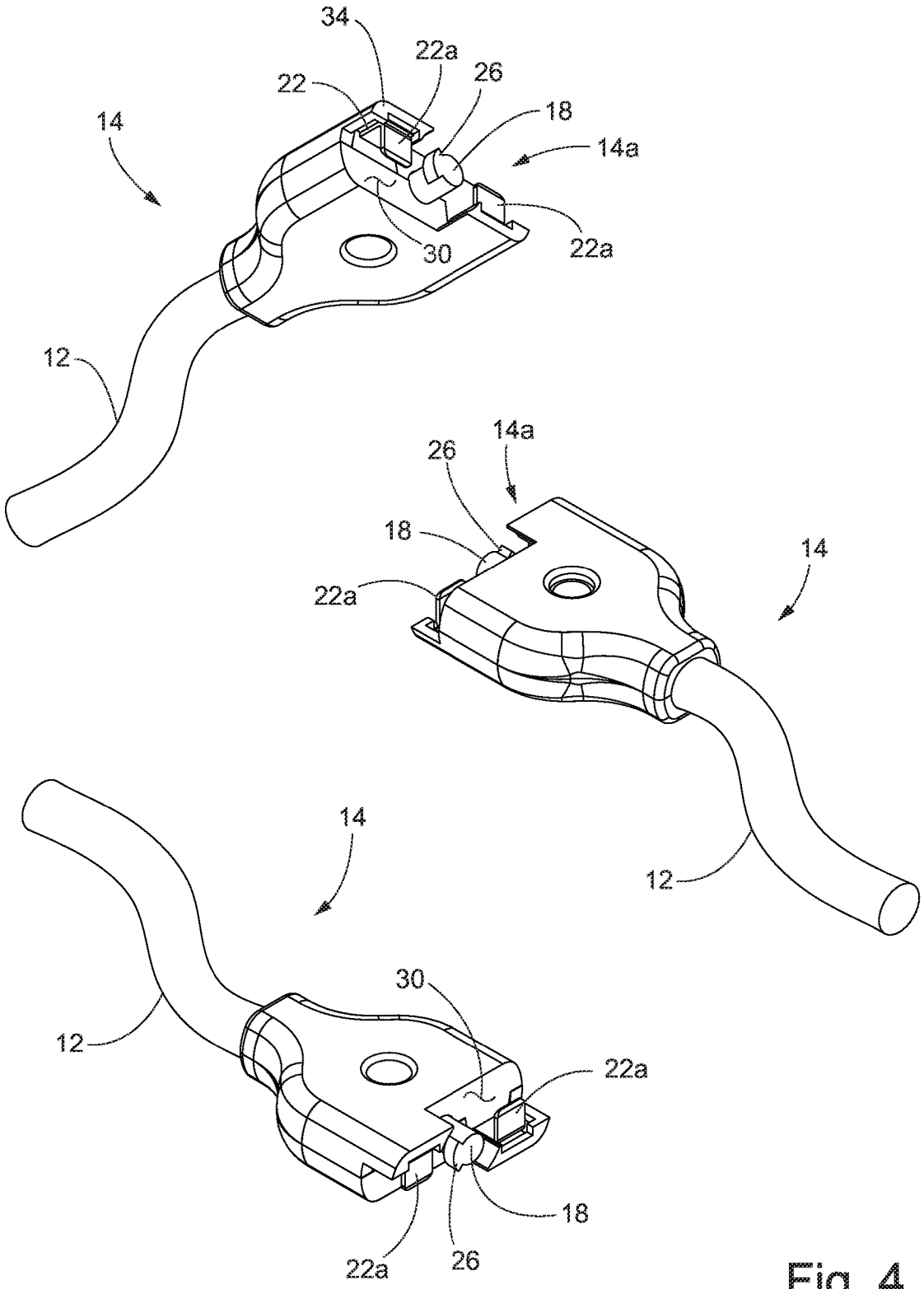
FIG. 4 is a series of three different perspective views of a first of the connector portions of FIG. 1.
Figure 5:
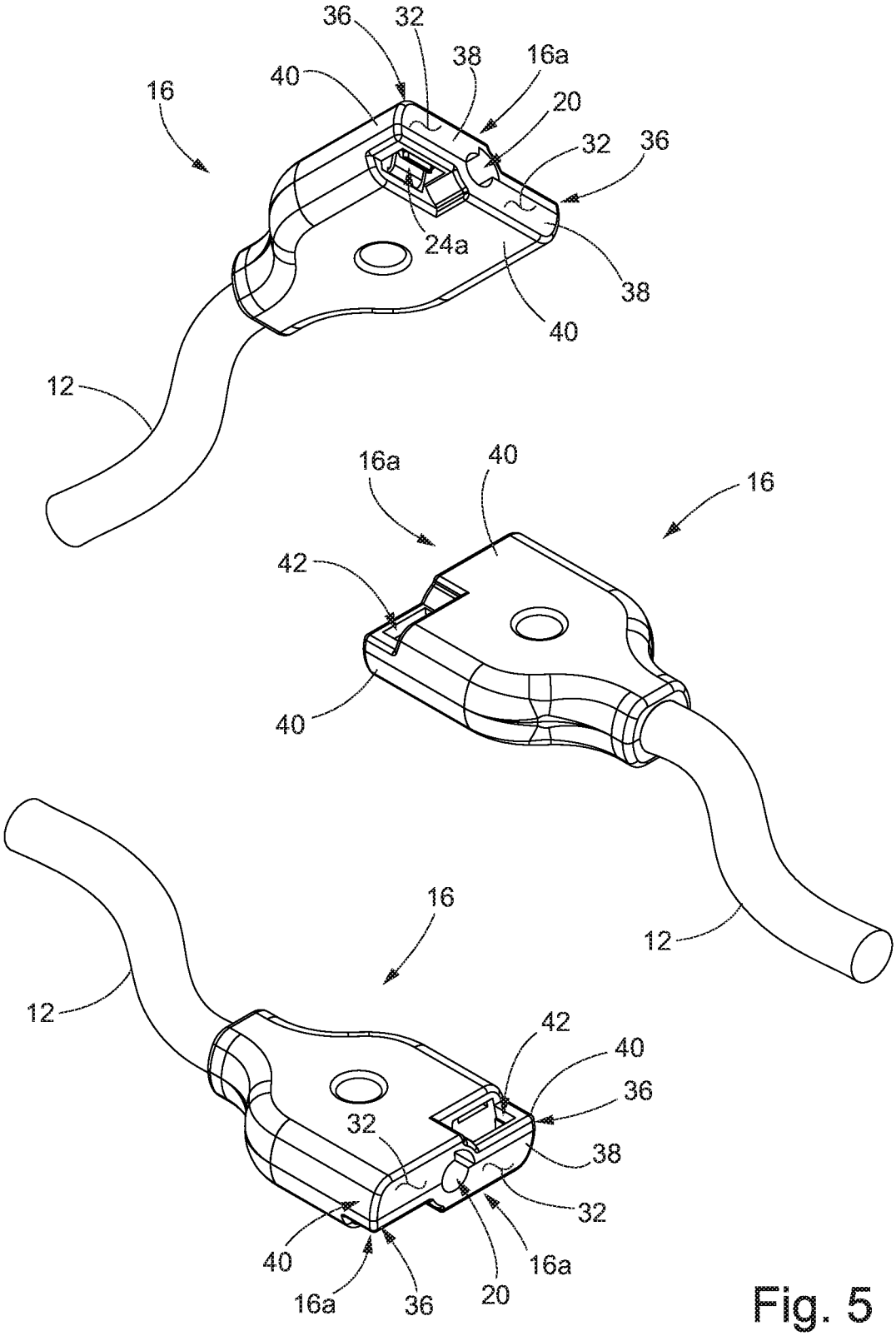
FIG. 5 is a series of three different perspective views of a second of the connector portions of FIG. 1.
Figure 6:
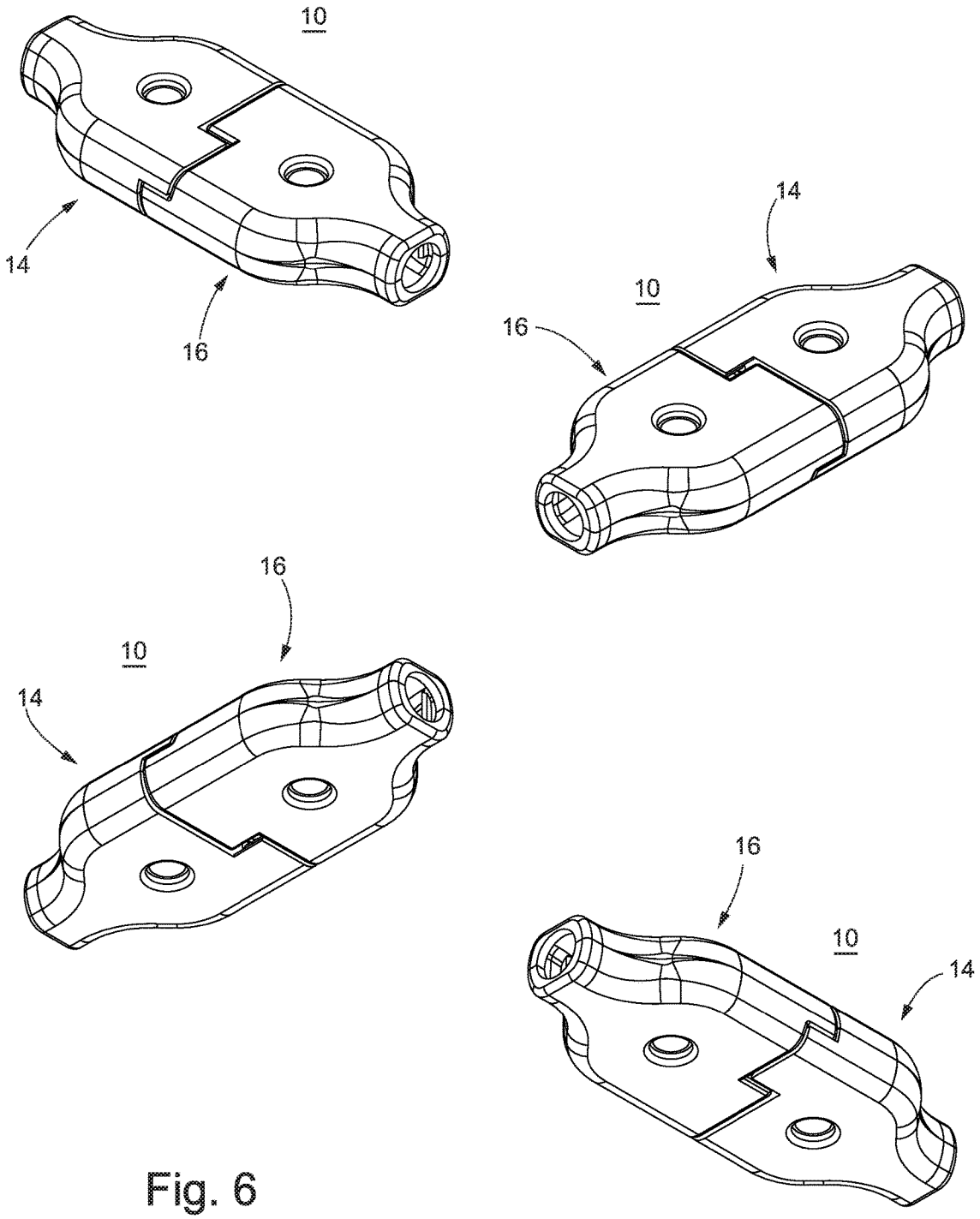
FIG. 6 is a series of four different perspective views of the twist-lock electrical connector of FIG. 3.

Referring now to the drawings and the illustrative embodiments depicted therein, a twist-lock electrical power connector 10 is designed to establish secure direct electrical connections for wiring 12, such as for an electrical appliance, electrical or data outlets, or the like (FIGS. 1-5). Twist-lock electrical connector 10 includes a first connector portion 14 and a second connector portion 16, each having a respective interface end portion 14*a*, 16*a*. Each connector portion 14, 16 has a respective longitudinal axis A1, A2 (FIGS. 1 and 2A) extending lengthwise through a central region of each connector portions. First connector portion 14 has a projection 18 extending distally outwardly along first longitudinal axis A1 at the first interface end portion 14*a* (FIGS. 1 and 4). Second connector portion 16 has a bore 20 extending into the second interface end portion 16*a* along second longitudinal axis A2 (FIGS. 1 and 5). First and second connector portions 14, 16 are configured to mechanically and electrically mate with one another in a two-step process such as shown in FIGS. 2A and 2*b* (first step) and in FIG. 3 (second step), and to resist inadvertent or accidental pull-apart once fully connected, as will be described in more detail below.

Interface end portion 14*a* of first connector portion 14 includes a first pair of electrical contacts 22 (FIGS. 4, 7A and 7B) that are each spaced laterally outwardly from first longitudinal axis A1, and spaced apart from one another on opposite sides of projection 18. Similarly, a second pair of electrical contacts 24 (FIGS. 5, 8A and 8B) are each spaced laterally outwardly from second longitudinal axis A2 of the second connector portion 16, located on opposite sides of bore 20.

The first and second connector portions 14, 16 are assembled together by initially aligning the first and second longitudinal axes A1, A2 so as to align projection 18 with bore 20, and then moving the connector portions together along the longitudinal axes so that projection 18 is received in bore 20, such as shown in FIGS. 1 and 2A. As will be explained below, first and second portions 14, 16 are mechanically configured so that their initial engagement, in the above-described manner, may be conducted only when the first connector portion 14 is at a first rotational orientation (about longitudinal axis A1) relative to second connector portion 16. It will be appreciated that upon initial engagement of the interface end portions 14*a*, 16*a*, first electrical contacts 22 do not make conductive electrical contact with second electrical contacts 24. Instead, electrical engagement of the first electrical contacts 22 with the respective second electrical contacts 24 is achieved by rotating first connector portion 14 relative to second connector portion 16 once projection 18 is substantially fully engaged in bore 20, such as shown in FIGS. 2B and 3.

In the illustrated embodiments, first and second interface end portions 14*a*, 16*a* have respective latching elements 26, 28 that are configured to engage one another upon rotation of first connector portion 14 relative to second connector portion 16 to the fully-engaged and connected position of FIGS. 3, 6 and 9-13. In the embodiment of FIGS. 1-13, first latching element 26 is a latch arm that extends radially outwardly from projection 18. Second latching element 28 is a ledge or recess (FIG. 12) that is formed along at least a portion of bore 20, and which is configured to receive latch arm 26 in the fully-engaged rotational orientation of connector portions 14, 16, so that the connector portions may not be pulled apart until they have first been rotated to disengage latch arm 26 from ledge 28, while simultaneously disengaging second electrical contacts 24 from first electrical contacts 22.

Figure 7A:
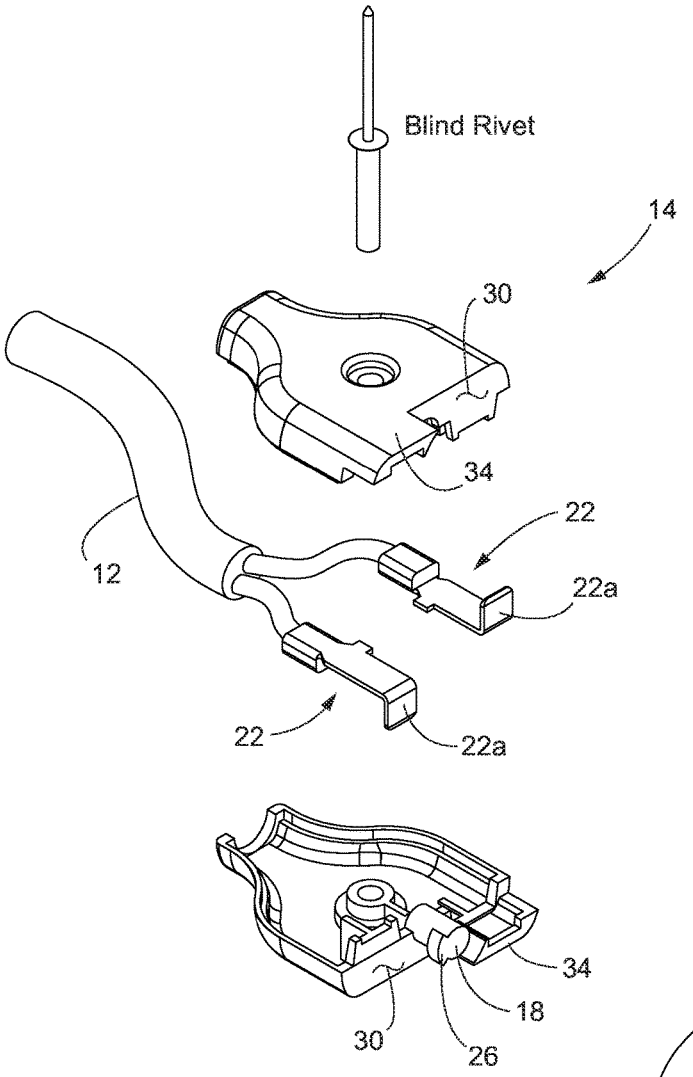
FIGS. 7A and 7B are exploded perspective views of the first connector portion of FIG. 4.
Figure 7B:
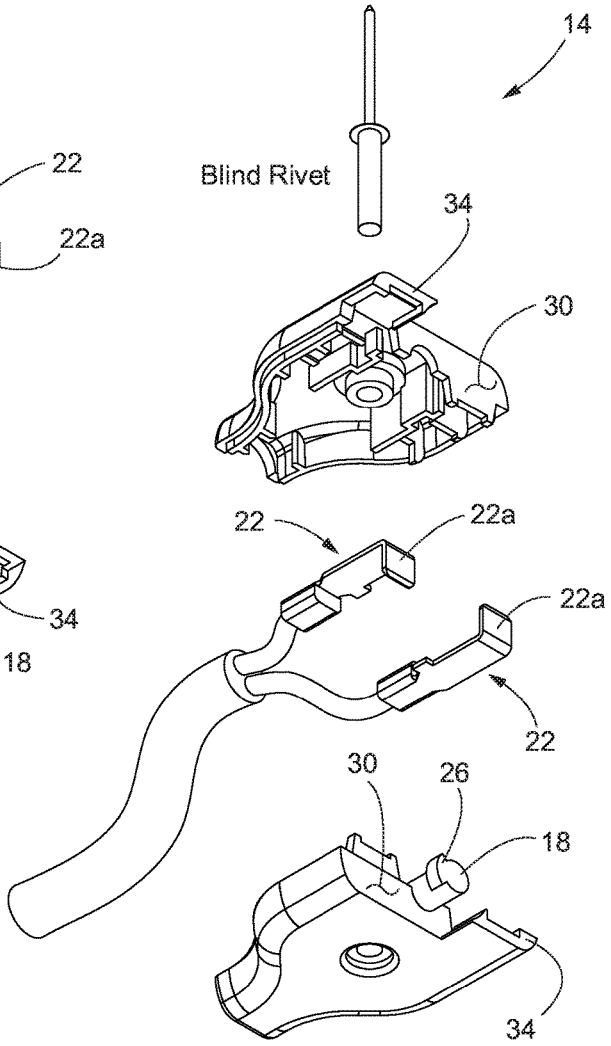
Figure 8A:
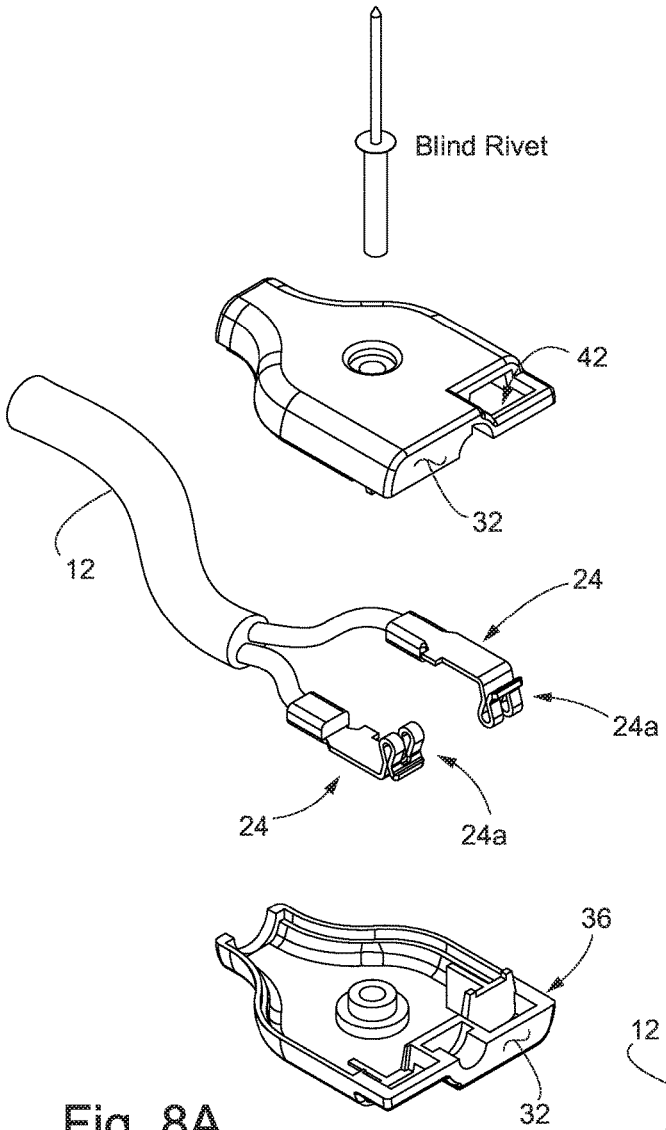
FIGS. 8A and 8B are exploded perspective views of the second connector portion of FIG. 5.
Figure 8B:
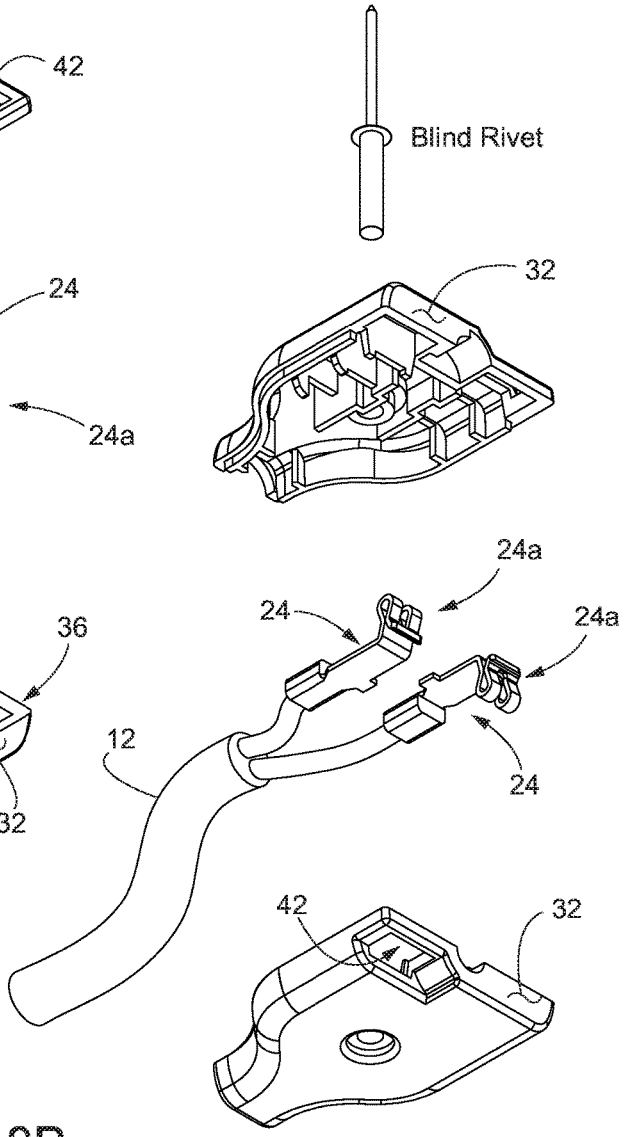
Figure 9:
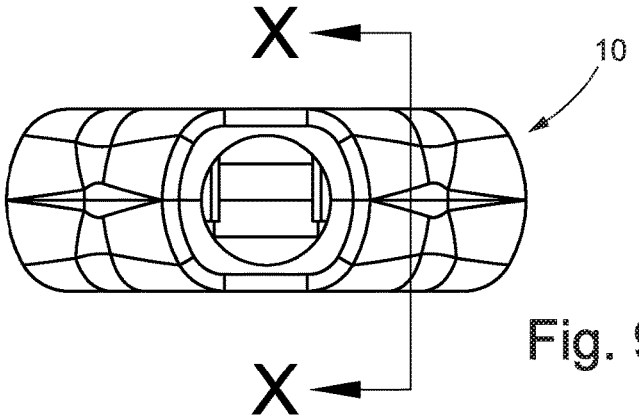
FIG. 9 is an end elevation of the twist-lock electrical connector of FIG. 3.
Figure 10:
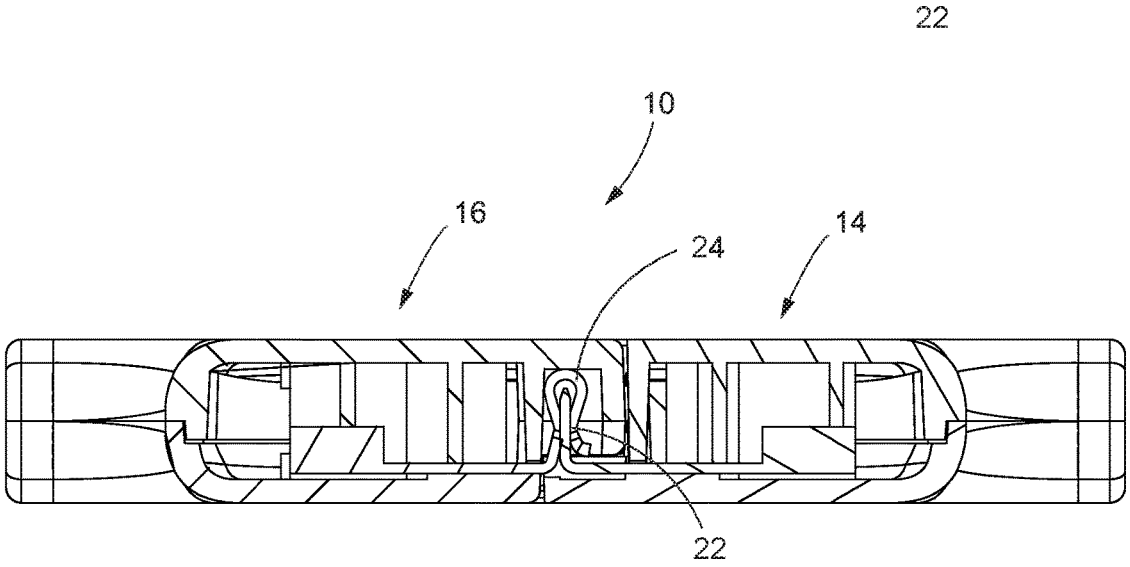
FIG. 10 is a sectional side elevation taken along section line X-X in FIG. 9.
Figure 11:
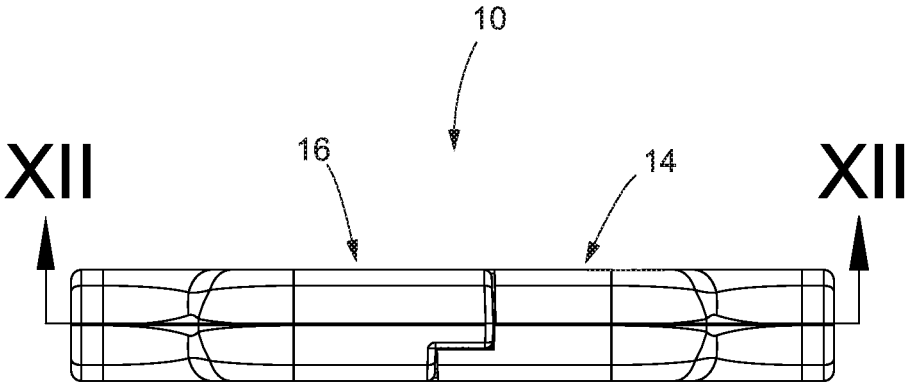
FIG. 11 is a side elevation of the twist-lock electrical connector of FIG. 3.
Figure 12:
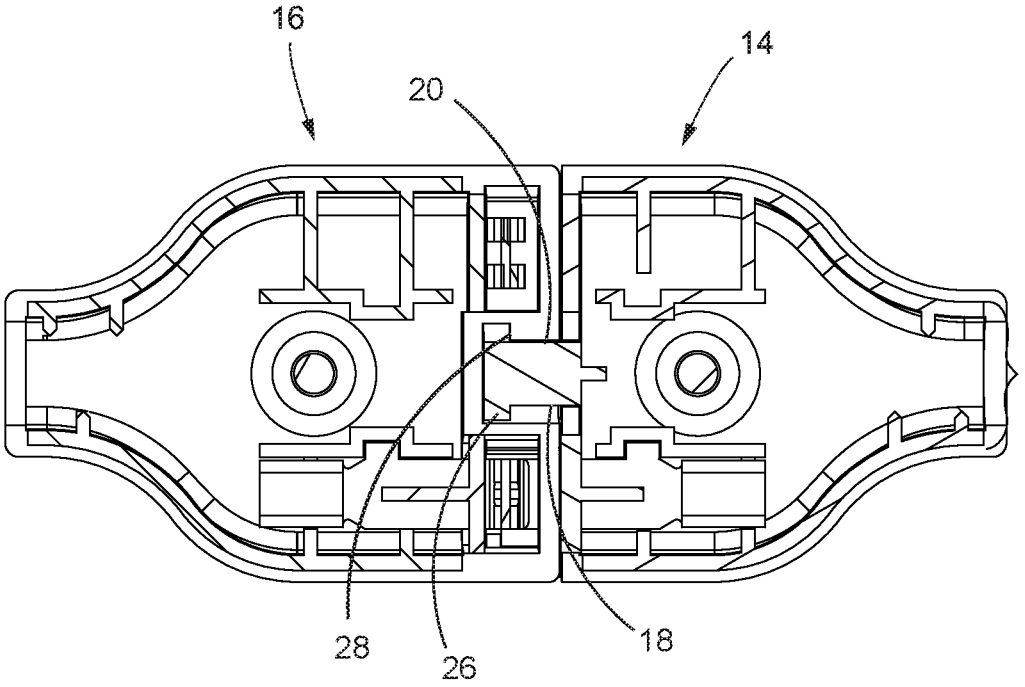
FIG. 12 is a sectional bottom plan view taken along section line XII-XII in FIG. 11.
Figure 13:
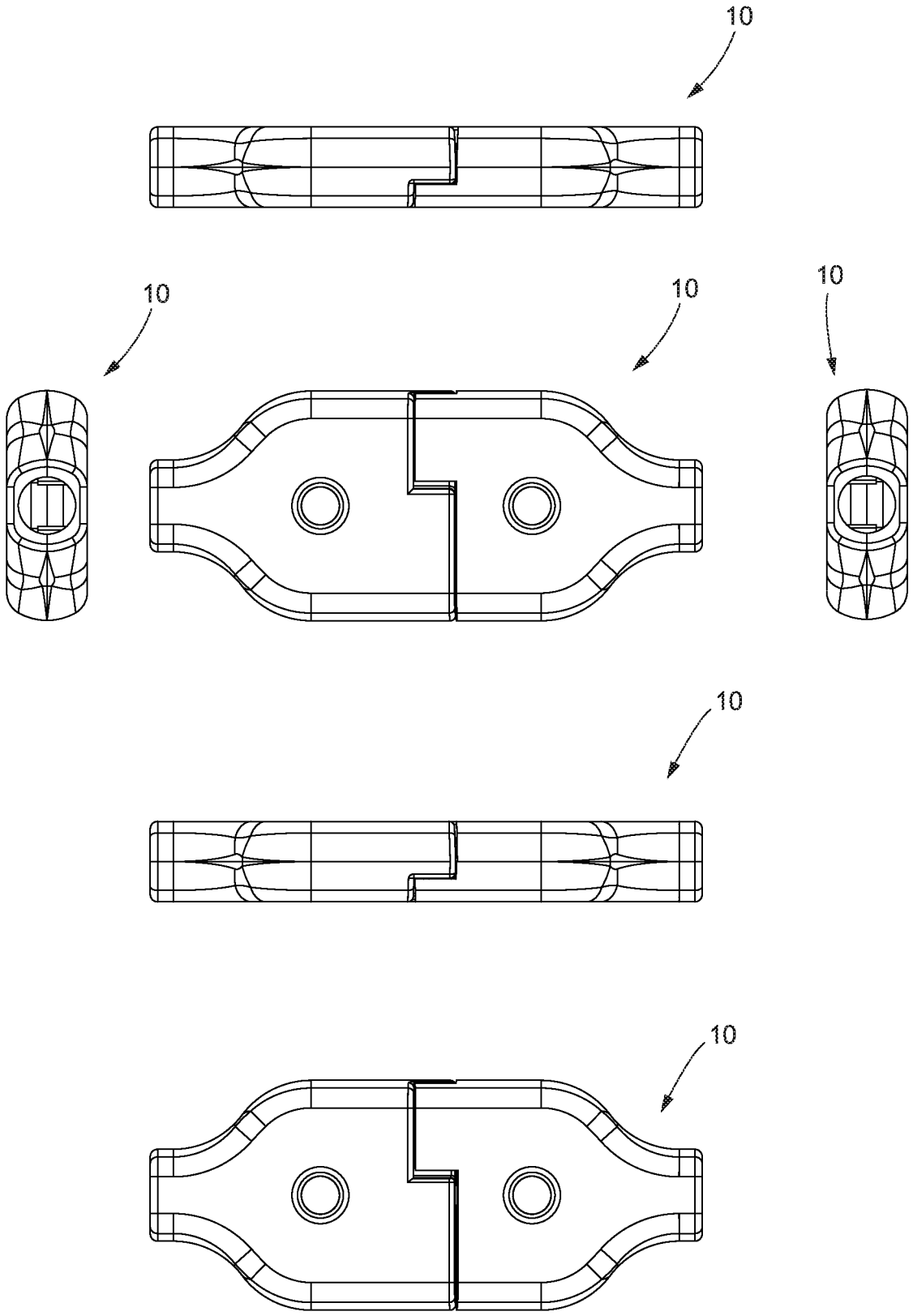
FIG. 13 is a series of two side elevations, top and bottom plan views, and two end elevation views of the twist-lock electrical connector of FIG. 3.
Figure 14:
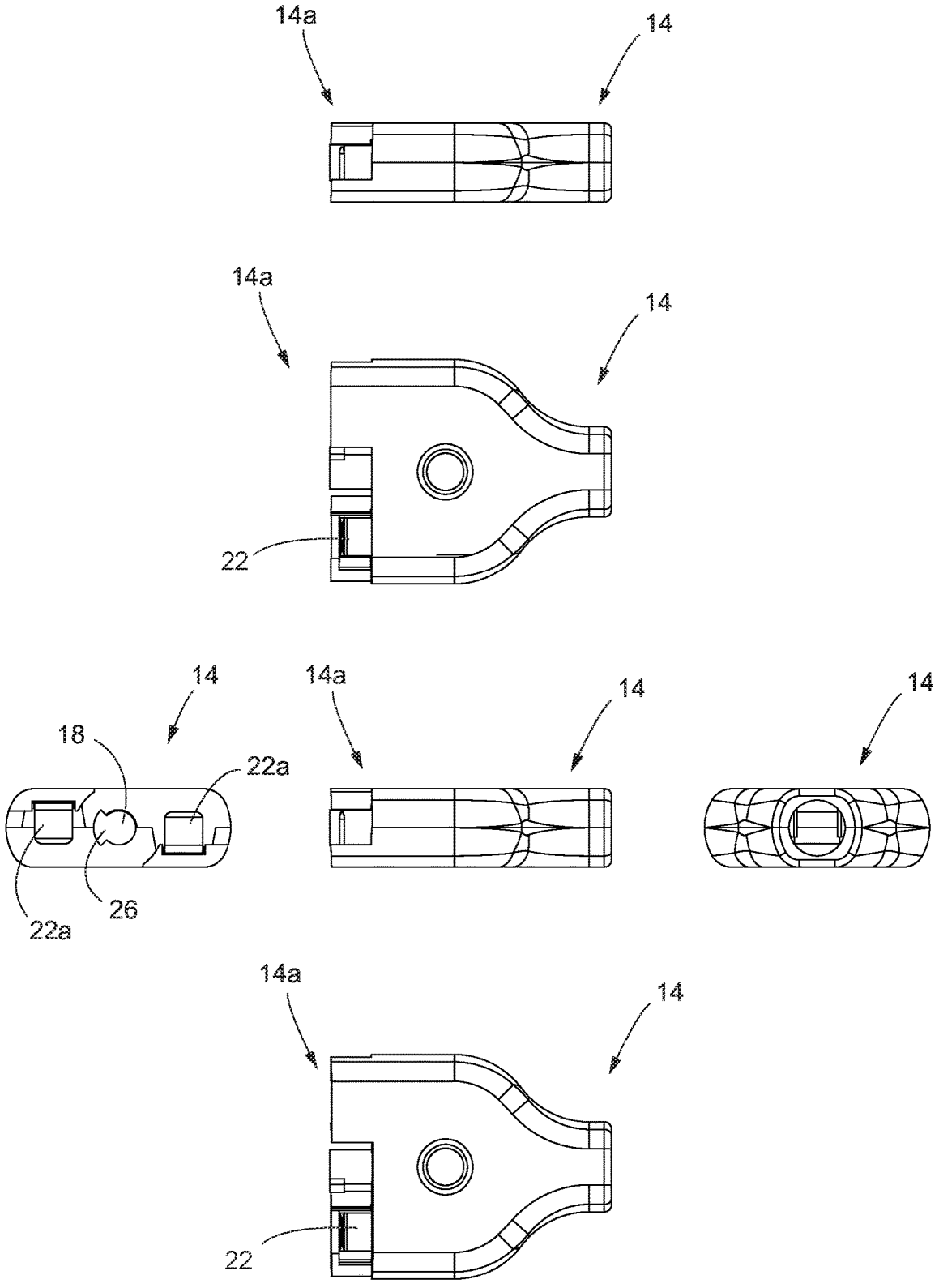
FIG. 14 is a series of two side elevations, top and bottom plan views, and two end elevation views of the first connector portion of FIG. 4.
Figure 15:
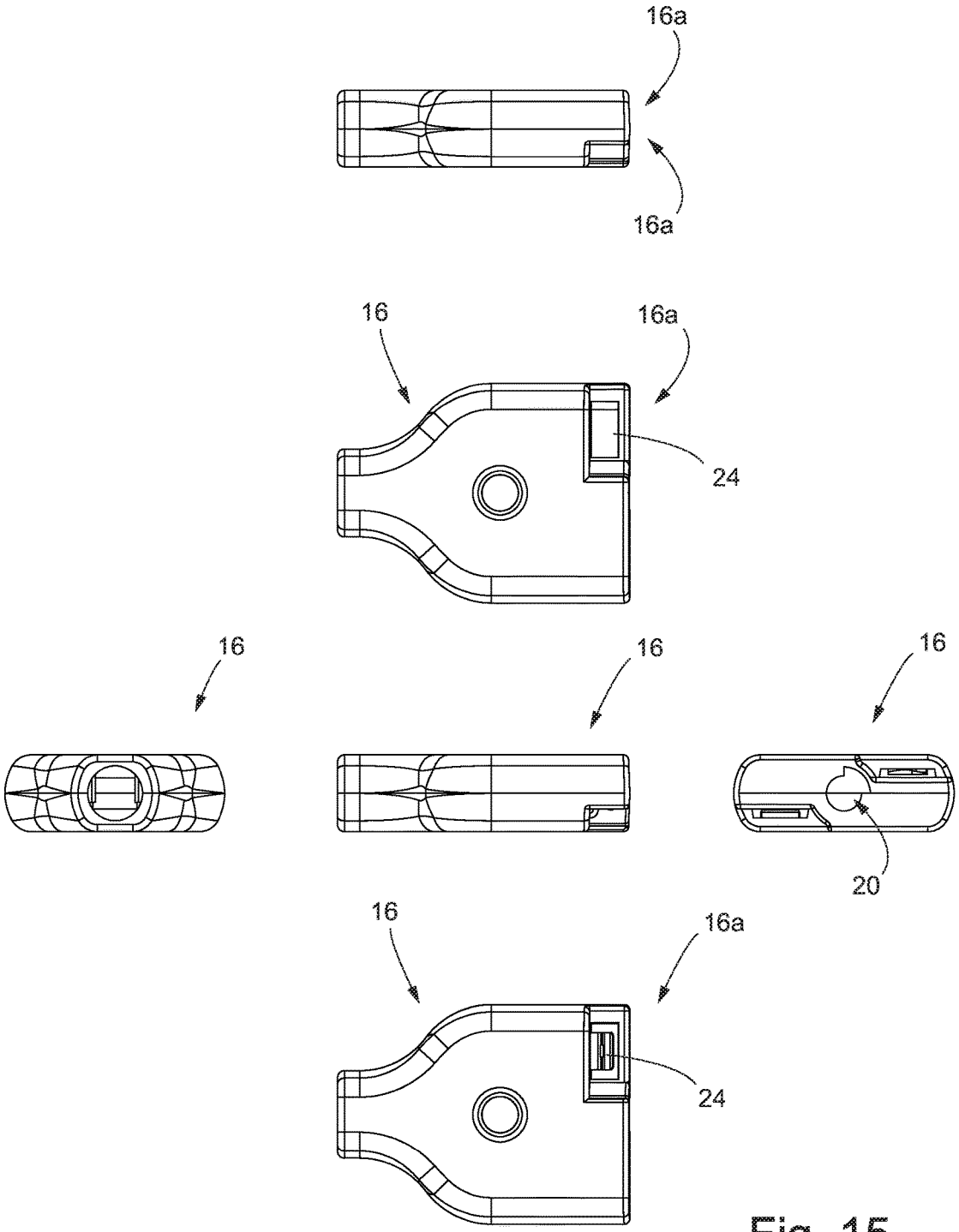
FIG. 15 is a series of two side elevations, top and bottom plan views, and two end elevation views of the second connector portion of FIG. 5.

Optionally, and as shown in FIGS. 10 and 12, first electrical contact 22 and second electrical contact 24 provide a latching function due to their respective shapes. First interface end portion 14*a* includes a generally planar engaging surface 30 (FIGS. 4, 7A and 7B) that is substantially perpendicular to first longitudinal axis A1, and second interface end portion 16*a* has a generally planar engaging surface 32 (FIGS. 5, 8A and 8B) that is substantially perpendicular to second longitudinal axis A2. First electrical contacts 22 project distally outwardly from planar engaging surface 30, such as shown in FIG. 4, and second electrical contacts 24 project distally outwardly from planar engaging surface 32, such as shown in FIG. 5. First electrical contacts 22 are generally L-shaped and have free ends including respective base legs 22*a* that are spaced distally outwardly from planar engaging surface 30 and are substantially parallel thereto (FIGS. 7A and 7B). In contrast, second electrical contacts 24 are generally U-shaped at their free ends 24*a*, forming a channel that is substantially parallel to, and spaced distally outwardly from, planar engaging surface 32 (FIGS. 8A and 8B). Base legs 22*a* of first electrical contacts 22 are spaced outwardly from planar engaging surface 30 by a distance that is approximately equal to the distance that channel openings in the U-shaped free ends 24*a* of second electrical contacts 24 are spaced outwardly from planar engaging surface 32. Thus, base legs 22*a* are received in the channel openings of U-shaped free ends 24*a* once first connector portion 14 is rotated to full engagement with second connector portion 16, such as shown in FIG. 10.

Optionally, and as shown in FIGS. 4, 7A and 7B, first interface end portion 14*a* includes a pair of electrically insulating extension walls 34 that extend distally outwardly from planar engaging surface 30 adjacent respective ones of first electrical contacts 22, on the opposite side of base legs 22*a*. Similarly, second interface end portion 16*a* includes a pair of electrically insulating extension housings 36 that extend distally outwardly from planar engaging surface 32 (FIGS. 5, 8A and 8B). Insulating extension housings 36 include end walls 38 that block contact with second electrical contacts 24, and with distal-extending walls 40 that surround second electrical contacts 24 on three sides thereof. Distal extending walls 40 and end wall 38 cooperate to define an opening 42 that provides access to the U-shaped free ends 24*a* of second electrical contacts 24 (FIG. 5).

Because of the limited access provided to second electrical contacts 24 through opening 42 in the insulating extension housings 36 at second interface end portion 16*a*, it will be appreciated that second connector portion 16 is most suitable for use as a connector for an electrical power source such that second electrical contacts 24 are live and have opposite polarities from one another (i.e., when used as a DC connector), or are the "hot" and "line" terminals of an AC power source. Therefore, the first electrical contacts 22 are energized only when connected with second electrical contacts 24. Because of the arrangement of insulating extension walls 34 and insulating extension housings 36, it will be appreciated that first electrical contacts 22 are not electrically energized until extension walls 34 are brought close to extension housings 36 to substantially preclude access to the electrical contacts 22, 24 when both sets of contacts are energized.

Figure 16:
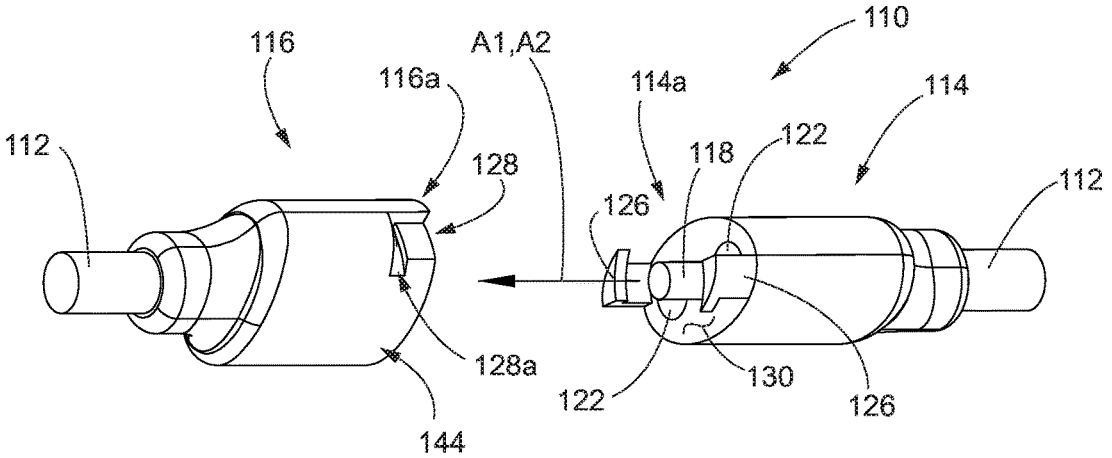
FIGS. 16-18 are perspective views of two connector portions of another twist-lock connector in accordance with the present invention, shown prior to initial engagement.
Figure 17:
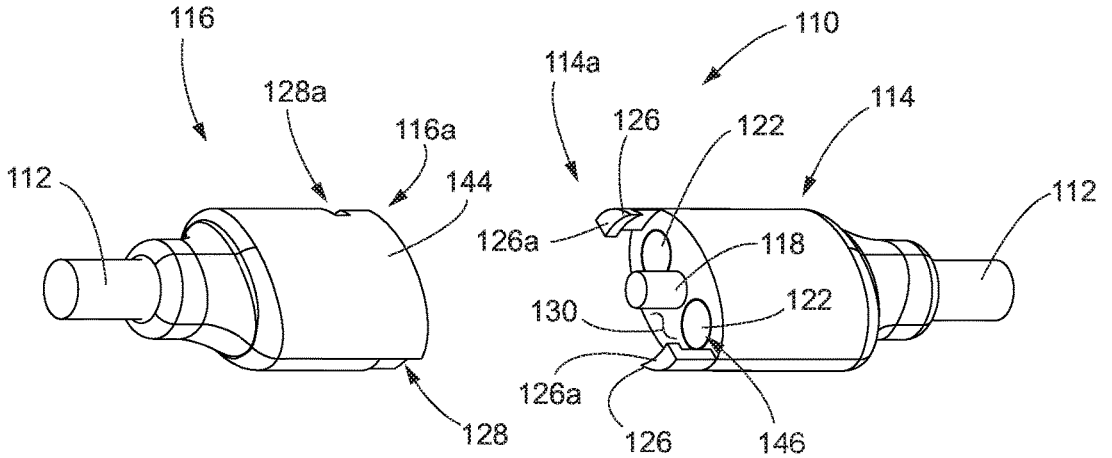
Figure 18:
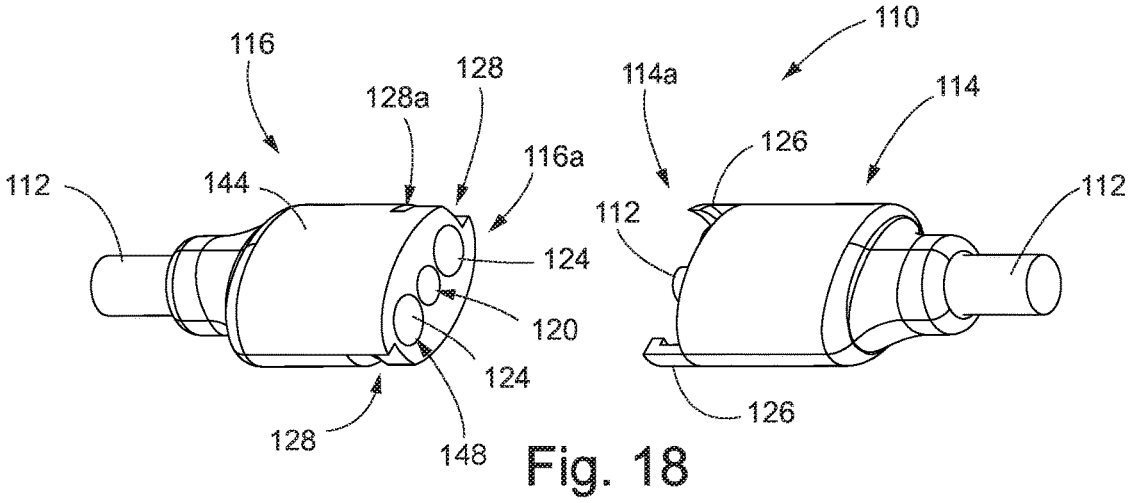
Figure 19:
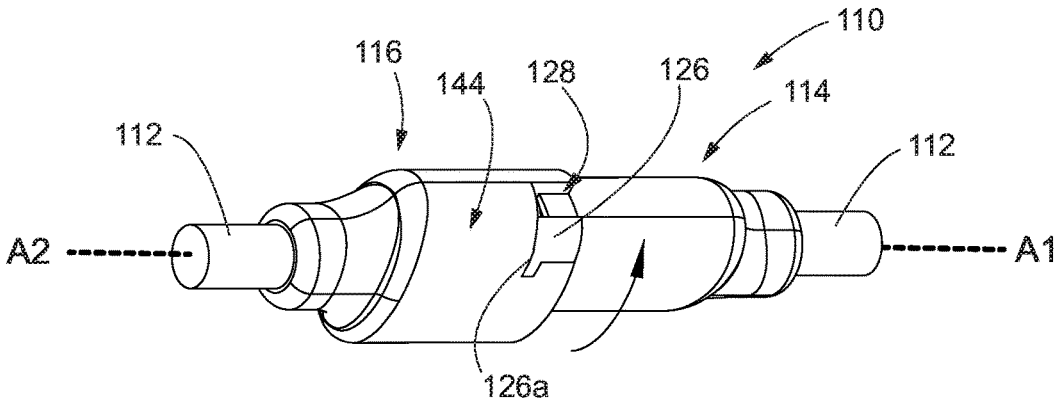
FIG. 19 is a perspective view of the two connector portions of FIGS. 16-18, shown after initial engagement and prior to final engagement.
Figure 20:
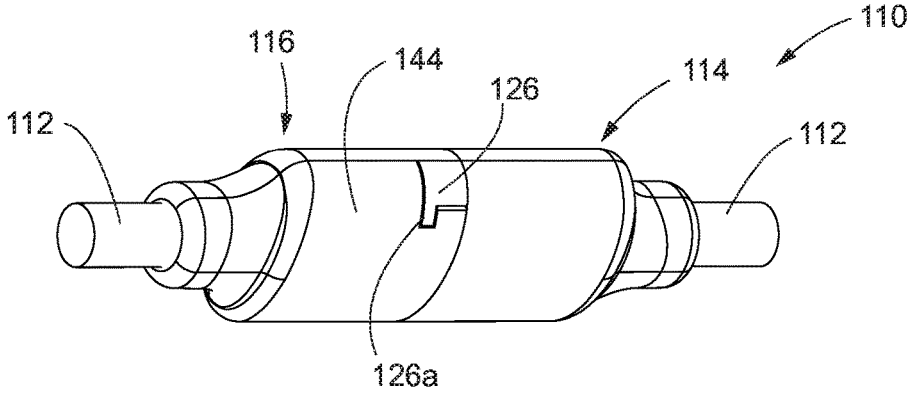
FIG. 20 is a perspective view of the two connector portions of FIG. 19, shown rotated to final engagement.
Figure 21:
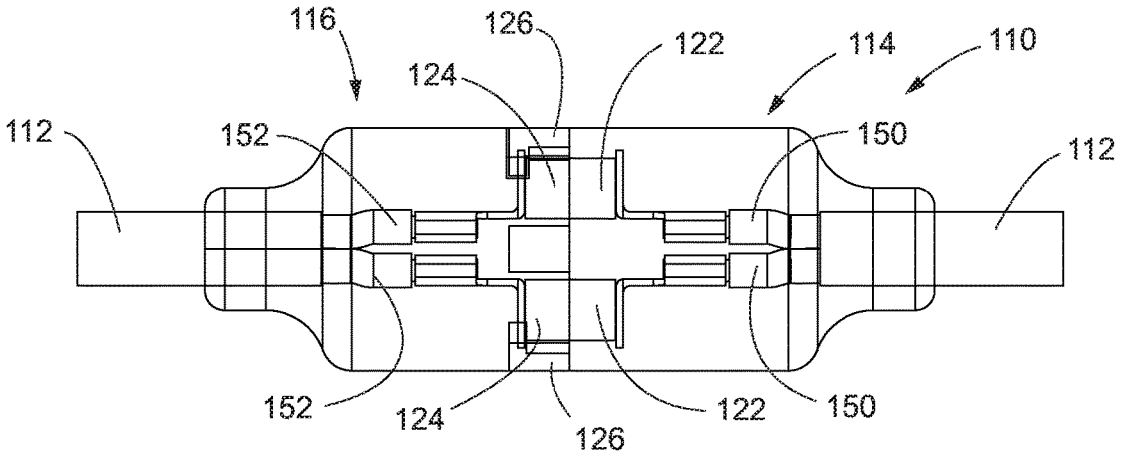
FIG. 21 is a side elevation and cutaway view showing internal structure of the twist-lock connector of FIG. 20.
Figure 22:
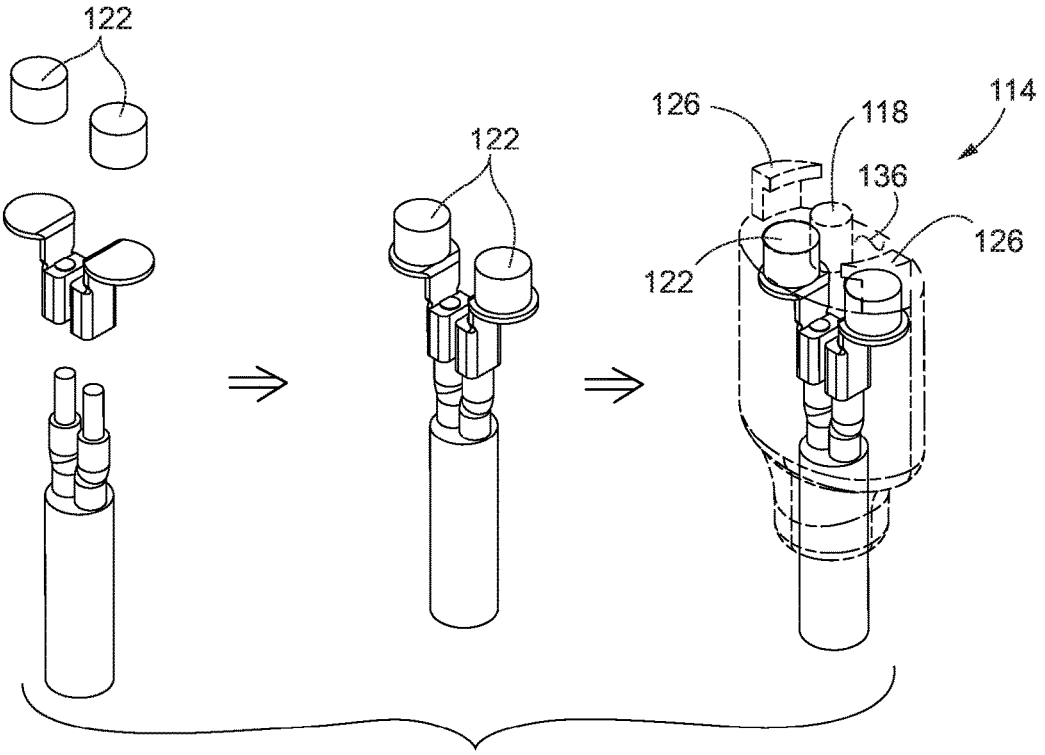
FIG. 22 is a series of three perspective views depicting assembly of a first of the connector portions of FIGS. 16-18.
Figure 23:
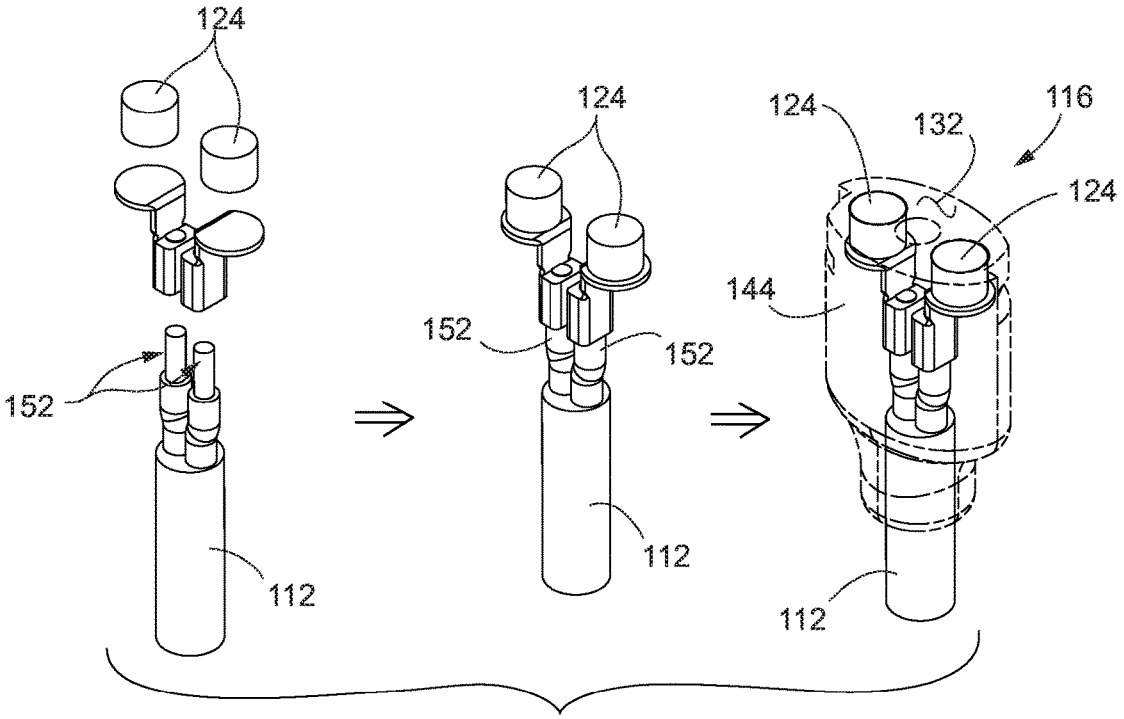
FIG. 23 is a series of three perspective views depicting assembly of a second of the connector portions of FIGS. 16-18.
Figure 24A:
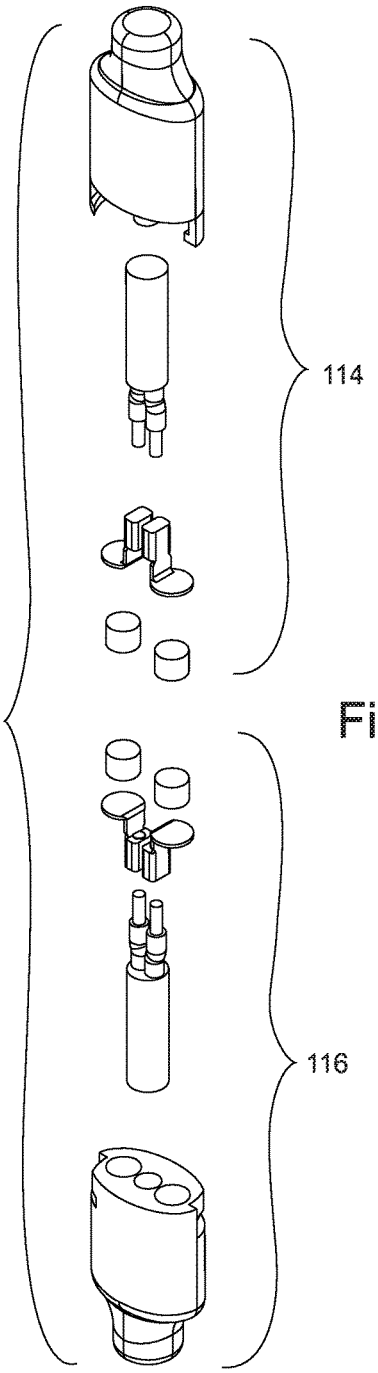
FIGS. 24A and 24B are exploded perspective views of the two connector portions of the twist-lock connector of FIGS. 16-18.
Figure 24B:
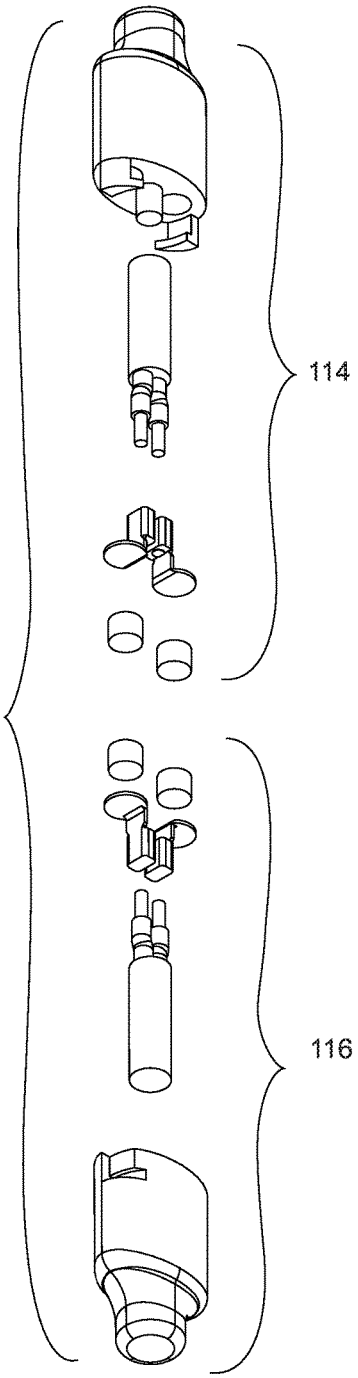
Figure 25:
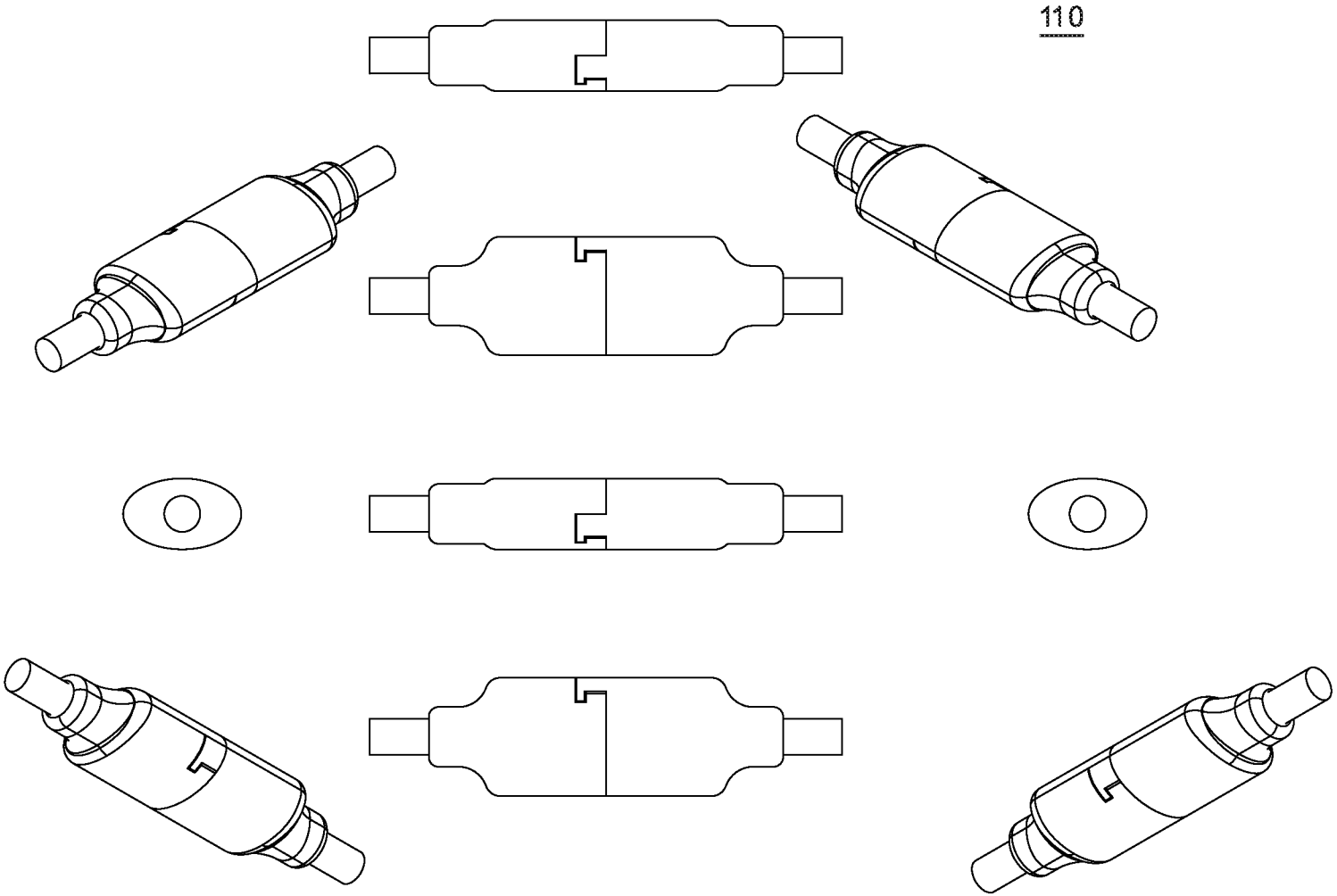
FIG. 25 is a series of four perspective views, four side elevations, and two end elevations of the twist-lock connector of FIG. 20.

Referring now to FIGS. 16-25, another twist-lock electrical power connector 110 is similar in many respects to connector 10, with like components given the same reference numerals with the addition of 100, such that a general understanding of the electrical power connector 110 may be obtained with reference to the above discussion, and the remaining description will focus on the differences found in the electrical power connector 110. Power connector 110 includes a first connector portion 114 having a central projection 118, and second connector portion 116 defining a central bore 120, such as shown in FIGS. 16-18, which provide an alignment function.

Unlike the electrical power connector 110, however, projection 118 and bore 120 do not provide a mechanical latching function, which instead is provided by first latching elements 126 in the form of generally L-shaped outboard projections that extend distally from a planar engaging surface 130 at a first interface end portion 114*a* of first connector portion 114. L-shaped first latching elements 126 have respective base legs that are spaced distally outwardly from planar engaging surface 130, and are substantially parallel to the planar engaging surface 130. Second connector portion 116 includes second latching elements 128 along a second interface portion 116*a*, which latching elements 128 are in the form of recesses that are formed or established in an outside side wall 144 of second interface end portion 116*a*. The second latching element recesses 128 have substantially corresponding shapes to the first latching elements 126, all of which are spaced laterally outwardly from the first or second longitudinal axes A1, A2 (FIG. 19) of the first and second connector portions 114, 116. The second latching element recesses 128 form respective ledges 128*a* that receive base legs 126*a* of the corresponding L-shaped first latching elements 126, such as shown in FIGS. 16-21.

Power connector 110 includes a first pair of electrical contacts 122, which are permanent magnets mounted in respective bores 146 formed in planar engaging surface 130 of first connector portion 114, on opposite sides of projection 118 (FIG. 17). Similarly, second connector portion 116 supports a pair of second electrical contacts 124, which are also permanent magnets (or may be substantially any magnetically permeable material such as a ferrous metal), which are received in respective bores 148 formed in a planar engaging surface 132 of second connector 116, on opposite sides of central bore 120 (FIG. 18).

First electrical contacts 122 and second electrical contacts 124 are electrically and mechanically coupled to respective conductors 150, 152 associated with wiring 112. Electrical contacts 122, 124 are held loosely in their respective bores 146, 148, which facilitates establishing sufficient electrical connection between respective ones of the electrical contacts 122, 124 when the first and second connector portions 114, 116 are mechanically coupled together. Optionally, a biasing member may be included inside each bore 146, 148 so as to draw or bias each electrical contact 122, 124 into the respective bore when the connector portions 114, 116 are disconnected, and so that the electrical contacts 122, 124 do not interfere with the rotation of the connector portions upon engagement of the respective planar engaging surfaces 130, 132. Thus, the respective forward surfaces of the electrical contacts 122, 124 may be slightly recessed in their respective bores 146, 148 until the connector portions 114, 116 are substantially fully rotated to their mating configuration (FIGS. 20, 21 and 25), at which point the magnetic attraction between the first and second electrical contacts 122, 124 draws them together to establish electrical continuity across electrical power connector 110. Because permanent magnets typically exhibit lower electrical conductivity compared to traditional conductive materials such as copper, it will be appreciated that the electrical connection across the first and second electrical contacts 122, 124 may be most suitable for relatively low voltage and low amperage DC power supplies and/or electronic signal or data transmission, as opposed to high voltage AC applications.

It will be appreciated that once the first connector portions 14, 114 are fully coupled to the respective second connector portions 16, 116, the electrical power connectors 10, 110 cooperate to form a substantially smooth contoured outer surface that resists catching on other objects or surfaces, such as when wiring 12, 112 is being pulled or otherwise moved during set up or usage. In other words, the outer surfaces of the first connector portions 14, 114 cooperate with the respective outer surfaces of the respective second connector portions 16, 116 form a substantially constant-section outer shape across the connection area when the connector portions are in their fully-connected orientation of FIGS. 3, 6, 9-13, 20, 21 and 25. Thus, the electrical power connectors 10, 110 are mechanically secured together and resist being pulled apart until the first and second connector portions are first rotated until the respective latching elements disengage one another. This facilitates reliable electrical continuity across the connectors even under conditions where cable or cord tension applies a pulling-apart force to the power connectors.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A twist-lock electrical connector comprising:

a first connector portion having a first interface end portion, a first longitudinal axis, and a projection at said first interface end portion along said first longitudinal axis;

a second connector portion having a second interface end portion, a second longitudinal axis, and a bore formed at said second interface end portion along said second longitudinal axis;

a pair of first electrical contacts at said first interface end portion and located at opposite sides of said projection;

a pair of second electrical contacts at said second interface end portion and located at opposite sides of said bore;

wherein said first and second interface end portions are configured to axially engage one another at a first rotational orientation in which said bore receives said projection when said first and second longitudinal axes are substantially coaxial; and wherein said first and second interface end portions are configured to rotatably engage one another at a second rotational orientation in which said first pair of electrical contacts electrically engage said second pair of electrical contacts.

2. The twist-lock electrical connector of claim 1, wherein said first and second interface end portions comprise respective first and second latching elements configured to engage one another in said second rotational orientation to thereby prevent separation of said first and second connector portions.

3. The twist-lock electrical connector of claim 2, wherein said first latching element comprises a latch arm extending radially outwardly from said projection, and said second latching element comprises a ledge formed along one side of said bore and configured to receive said latch arm in said second rotational orientation.

4. The twist-lock electrical connector of claim 2, wherein said first latching element comprises respective distal end portions of said first pair of electrical contacts, wherein said distal end portions are substantially perpendicular to said first longitudinal axis, and said second latching element comprises said second pair of electrical contacts.

5. The twist-lock electrical connector of claim 4, wherein said first latching elements are generally L-shaped having a free end comprising a base leg and said second latching elements are generally U-shaped at respective free ends thereof, and wherein said base legs of said first latching elements are received in said U-shaped free ends of said second latching elements.

6. The twist-lock electrical connector of claim 5, further comprising a pair of electrically insulating extension walls extending distally adjacent each of said first latching elements, and a pair of electrically insulating extension housings extending distally around each of said second latching elements, wherein said extension housings each define a respective opening through which respective ones of said U-shaped free ends of said second latching elements are engaged by respective ones of said base legs of said L-shaped first latching elements.

7. The twist-lock electrical connector of claim 2, wherein a first of said latching elements comprises at least one outboard projection at said first interface end portion and spaced radially outwardly from said first longitudinal axis, and wherein a second of said latching elements comprises a recess formed in said second interface end portion and spaced radially outwardly from said second longitudinal axis.

8. The twist-lock electrical connector of claim 7, wherein said first latching element is generally L-shaped and said second latching element comprises a generally L-shaped recess formed in an outer surface of said second interface end portion.

9. The twist-lock electrical connector of claim 1, wherein each of said first and second pairs of electrical contacts comprises permanent magnets or magnetically permeable material, wherein said first pair of electrical contacts is magnetically attracted to said second pair of electrical contacts in said second rotational orientation.

10. The twist-lock electrical connector of claim 9, wherein said first and second pairs of electrical contacts are movable within respective contact bores formed in said first and second interface end portions to facilitate establishing electrical engagement of said first pair of electrical contacts with said second pair of electrical contacts.

11. A twist-lock electrical connector comprising:

a first connector portion having a first longitudinal axis, a first interface end portion including a first generally planar engagement surface, and a pair of extension walls extending forwardly from said first engagement surface and located on opposite sides of said first longitudinal axis;

a pair of first electrical contacts at said first interface end portion, said first electrical contacts extending forwardly of said first engagement surface and located adjacent respective ones of said extension walls;

a second connector portion having a second longitudinal axis, a second interface end portion including a second generally planar engagement surface, and a pair of contact openings positioned rearwardly of said second engagement surface and on opposite sides of said second longitudinal axis;

a pair of second electrical contacts positioned in said second interface end portion and accessible via respective ones of said contact openings;

wherein said first and second interface end portions are configured to initially engage one another at a first orientation in which said first and second longitudinal axes are substantially coaxial and said first electrical contacts are not contacting said second electrical contacts; and wherein said first and second interface end portions are configured to further engage one another at a second orientation in which said first electrical contacts engage respective ones of said second electrical contacts and said contact openings are covered by said extension walls.

12. The twist-lock electrical connector of claim 11, wherein said first engagement surface is substantially perpendicular to said first longitudinal axis and said second generally planar engagement surface is substantially perpendicular to said second longitudinal axis.

13. The twist-lock electrical connector of claim 11, wherein respective outer surfaces of said first and second connector portions cooperate to form a substantially constant-section shape along said first and second interface end portions when in said second orientation.

14. The twist-lock electrical connector of claim 11, wherein said first or second connector portion comprises a projection extending along said first or second longitudinal axis, and the other of said first or second connector portion comprises a bore extending along said second longitudinal axis, wherein said bore is configured to receive said projection in both of said first and second orientations.

15. The twist-lock electrical connector of claim 14, wherein said projection comprises a radially outwardly extending latch arm formed along one side thereof, and said bore comprises a ledge formed along one side thereof, wherein said latch arm is configured to engage said ledge in said second orientation to thereby prevent separation of said first and second connector portions.

16. The twist-lock electrical connector of claim 11, wherein said first electrical contacts are generally L-shaped with free ends comprising base legs extending away from respective ones of said extension walls, and said second electrical contacts are generally U-shaped at respective free ends thereof, wherein said base legs of said first electrical contacts are received in said U-shaped free ends of said second electrical contacts in said second orientation, wherein engagement of said first electrical contacts with respective ones of said second electrical contacts secures said first and second connector portions together in said second orientation.

17. The twist-lock electrical connector of claim 16, wherein said first or second connector portion comprises a projection extending along said first or second longitudinal axis, and the other of said first or second connector portion comprises a bore extending along said second longitudinal axis, wherein said bore is configured to receive said projection in both of said first and second orientations.

18. The twist-lock electrical connector of claim 17, wherein said projection comprises a radially outwardly extending latch arm formed along one side thereof, and said bore comprises a ledge formed along one side thereof, wherein said latch arm is configured to engage said ledge in said second orientation to thereby prevent separation of said first and second connector portions.

19. A twist-lock electrical connector comprising:

a first connector portion having a first interface end portion, a first longitudinal axis, and a projection at said first interface end portion and extending along said first longitudinal axis, said projection having a radially outwardly extending latch arm formed at a distal end portion thereof;

a second connector portion having a second interface end portion, a second longitudinal axis, and a bore formed at said second interface end portion along said second longitudinal axis, said bore comprising an internal radially outwardly extending ledge;

a pair of first electrical contacts at said first interface end portion and located at opposite sides of said projection;

a pair of second electrical contacts at said second interface end portion and located at opposite sides of said bore;

wherein said first and second interface end portions are configured to axially engage one another at a first rotational orientation in which said bore receives said projection when said first and second longitudinal axes are substantially coaxial; and wherein said first and second interface end portions are configured to rotatably further engage one another at a second rotational orientation in which said first pair of electrical contacts electrically engage said second pair of electrical contacts and said latch arm engages said ledge to thereby prevent separation of said first and second connector portions.

20. The twist-lock electrical connector of claim 19, wherein said first electrical contacts are generally L-shaped with free ends comprising base legs extending away from respective ones of said extension walls, and said second electrical contacts are generally U-shaped at respective free ends thereof, wherein said base legs of said first electrical contacts are received in said U-shaped free ends of said second electrical contacts in said second orientation.

* * * * *